US008994707B2

(12) United States Patent
Kim et al.

(10) Patent No.: US 8,994,707 B2
(45) Date of Patent: Mar. 31, 2015

(54) DISPLAY DEVICE AND METHOD FOR DRIVING THE SAME

(71) Applicant: LG Display Co., Ltd., Seoul (KR)

(72) Inventors: Jin-Hyoung Kim, Goyang-si (KR); Seung-Tae Kim, Goyang-si (KR); Ho-Min Lim, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 135 days.

(21) Appl. No.: 13/725,715

(22) Filed: Dec. 21, 2012

(65) Prior Publication Data

US 2013/0169616 A1 Jul. 4, 2013

(30) Foreign Application Priority Data

Dec. 29, 2011 (KR) ..... 10-2011-0145859

(51) Int. Cl.

*G09G 5/00* (2006.01)
*G09G 3/32* (2006.01)
*G09G 3/20* (2006.01)

(52) U.S. Cl.

CPC ..... *G09G 3/3233* (2013.01); *G09G 3/20* (2013.01); *G09G 2310/0248* (2013.01); *G09G 2310/0254* (2013.01); *G09G 2310/027* (2013.01)

USPC ..... 345/209; 345/54; 345/79; 345/96

(58) Field of Classification Search

USPC ..... 345/54, 79, 87–104, 204–214, 690–699
See application file for complete search history.

(56) References Cited

U.S. PATENT DOCUMENTS

| | | | | |
|---|---|---|---|---|
| 5,892,493 | A * | 4/1999 | Enami et al. | 345/94 |
| 8,063,875 | B2 * | 11/2011 | Ishii | 345/103 |
| 2005/0088387 | A1 | 4/2005 | Yokoyama et al. | |
| 2005/0093769 | A1 | 5/2005 | Ushigusa et al. | |
| 2006/0291298 | A1 | 12/2006 | Kang et al. | |
| 2008/0043012 | A1 | 2/2008 | Shirai | |
| 2010/0128011 | A1 * | 5/2010 | Ito | 345/209 |
| 2011/0292012 | A1 * | 12/2011 | Huang et al. | 345/209 |

FOREIGN PATENT DOCUMENTS

| | | | |
|---|---|---|---|
| CN | 1598917 | A | 3/2005 |
| CN | 1609936 | A | 4/2005 |
| CN | 1773601 | A | 5/2006 |
| CN | 1897080 | A | 1/2007 |
| CN | 103035200 | A | 4/2013 |
| DE | 696 29 985 | T2 | 7/2004 |
| EP | 0 755 044 | A1 | 1/1997 |

* cited by examiner

*Primary Examiner* — Dmitriy Bolotin
(74) *Attorney, Agent, or Firm* — Birch, Stewart, Kolasch & Birch, LLP

(57) ABSTRACT

Discussed are a display device and a method for controlling the same, which are capable of achieving a reduction in power consumption, through selective application of a charge share mode or a pre-charge mode in accordance with the swing width of a data voltage. The disclosed method includes the steps of determining a positive or negative polarity of input image data on the basis of reference data and outputting a pre-charge enable signal when two successive image data have the same polarity; supplying a pre-charge voltage to a corresponding output channel in response to the pre-enable signal; and converting the image data into a data voltage, supplying the converted data voltage to a corresponding data line through the corresponding output channel.

14 Claims, 5 Drawing Sheets

| Time | Scan1 | Scan2 | Scan3 | Scan4 | Scan5 | Scan6 | Scan7 |
|---|---|---|---|---|---|---|---|
| Reference data | 85 | | | | | | |
| Input data | 0 | 64 | 128 | 255 | 128 | 64 | 0 |
| POL (n) | 0 | 0 | 1 | 1 | 1 | 0 | 0 |
| POL (n - 1) | 0 | 0 | 0 | 1 | 1 | 1 | 0 |
| Pre_EN | 0 | 0 | 1 | 0 | 0 | 1 | 0 |
| Control | Disable | Disable | Enable | Disable | Disable | Enable | Disable |

DISPLAY DEVICE AND METHOD FOR DRIVING THE SAME

This application claims the benefit of Korean Patent Application No. 10-2011-0145859, filed on Dec. 29, 2011, which is hereby incorporated by reference as if fully set forth herein.

BACKGROUND OF THE INVENTION

1. Field of the Invention

The present invention relates to a display device and a method for controlling the same, which are capable of achieving a reduction in power consumption, through selective application of a charge share mode or a pre-charge mode in accordance with the swing width of a data voltage.

2. Discussion of the Related Art

Conventional display devices employ a charge share mode or a pre-charge mode, to reduce the swing width of a data voltage, and thus to reduce power consumption and heat generation of a data driving circuit using the data voltage.

The above-mentioned modes can achieve reduction of power consumption when data voltages, which are successively output, exhibit a great level difference. However, when the successively-output data voltages exhibit a small level difference, the modes may increase the swing width of each data voltage. As a result, power consumption increases. Furthermore, in the case of a light emitting display device, there is a difficulty in selectively applying the charge share mode in accordance with the polarity of data voltage because the data voltage used in the light emitting display device does not have polarity, differently from liquid crystal display devices.

SUMMARY OF THE INVENTION

Accordingly, the present invention is directed to a display device and a method for driving the same that substantially obviate one or more problems due to limitations and disadvantages of the related art.

An object of the present invention is to provide a display device and a method for controlling the same, which are capable of achieving a reduction in power consumption, through selective application of a charge share mode or a pre-charge mode in accordance with the swing width of a data voltage.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a display device includes a display panel, in which pixels are defined by intersection of a plurality of gate lines and a plurality of data lines, a timing controller for determining a positive or negative polarity of input image data on the basis of reference data and outputting a pre-charge enable signal when successive image data have different polarity; a data driver for converting image data supplied from the timing controller into a data voltage, supplying the converted data voltage to the corresponding data line through a corresponding output channel, and supplying a pre-charge voltage to the corresponding output channel in response to the pre-charge enable signal; and a gate driver for supplying scan signals to the gate lines, respectively.

The timing controller may include a polarity determiner for outputting a first polarity data when input image data is equal to or higher than the reference data, and outputting a second polarity data when the input image data is lower than the reference data, and a comparator for comparing polarity data of a current image data with polarity data of a previous image data, and if the compared polarity data are equal, the comparator outputs a pre-charge enable signal which indicates the pre-charge mode, and otherwise the comparator outputs a pre-charge enable signal which indicates the charge share mode.

The reference data may include red reference data is predetermined for RGB data individually or in common.

The reference data is predetermined for R, G, B and w data individually or in common.

The polarity determiner may compare the input image data with the reference data for 4 higher-order bits thereof, and output the polarity data based on a result of the comparison; and wherein the comparator compares a polarity data of a current image data with a polarity data of a previous image data and output the pre-charge enable signal in response to the compared result.

The data driver may include a latch for sequentially latching the pre-charge enable signal supplied from the timing controller, an AND logic for ANDing a pre-charge out enable signal supplied from the timing controller and the pre-charge enable signal supplied from the latch, and a pre-charging switch unit for supplying the pre-charge voltage to the corresponding output channel when an output signal from the AND logic has a high level.

The pre-charge out enable signal may be a signal synchronized with or identical to a source output enable (SOE) signal, which defines an output period of the data driver.

The pre-charge voltage may be a voltage corresponding to the reference data.

In another aspect of the present invention, a method for driving a display device includes the steps of determining a positive or negative polarity of input image data on the basis of reference data and outputting a pre-charge enable signal when two successive image data have different polarity, supplying a pre-charge voltage to a corresponding output channel in response to the pre-enable signal; and converting the image data into a data voltage, supplying the converted data voltage to a corresponding data line through the corresponding output channel.

The step of outputting the pre-charge enable signal may include the steps of (A) outputting a first polarity data when input image data is equal to or higher than the reference data, and outputting a second polarity data when the input image data is lower than the reference data, and (B) comparing polarity data of a current image data with polarity data of a precious image data, and if the compared polarity data are equal, outputting a pre-charg enable signal which indicates a pre-charge mode, and otherwise outputting a pre-charge enable signal which indicates a charge share mode.

The step of supplying the pre-charge voltage to the corresponding output channel in response to the pre-charge enable signal may include the steps of sequentially latching the pre-charge enable signal corresponding each of the input image data, ANDing a pre-charge out enable signal and the pre-charge enable signal, thereby outputting an ANDed signal, and supplying the pre-charge voltage to the corresponding output channel when the ANDed signal has a high level.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and along with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
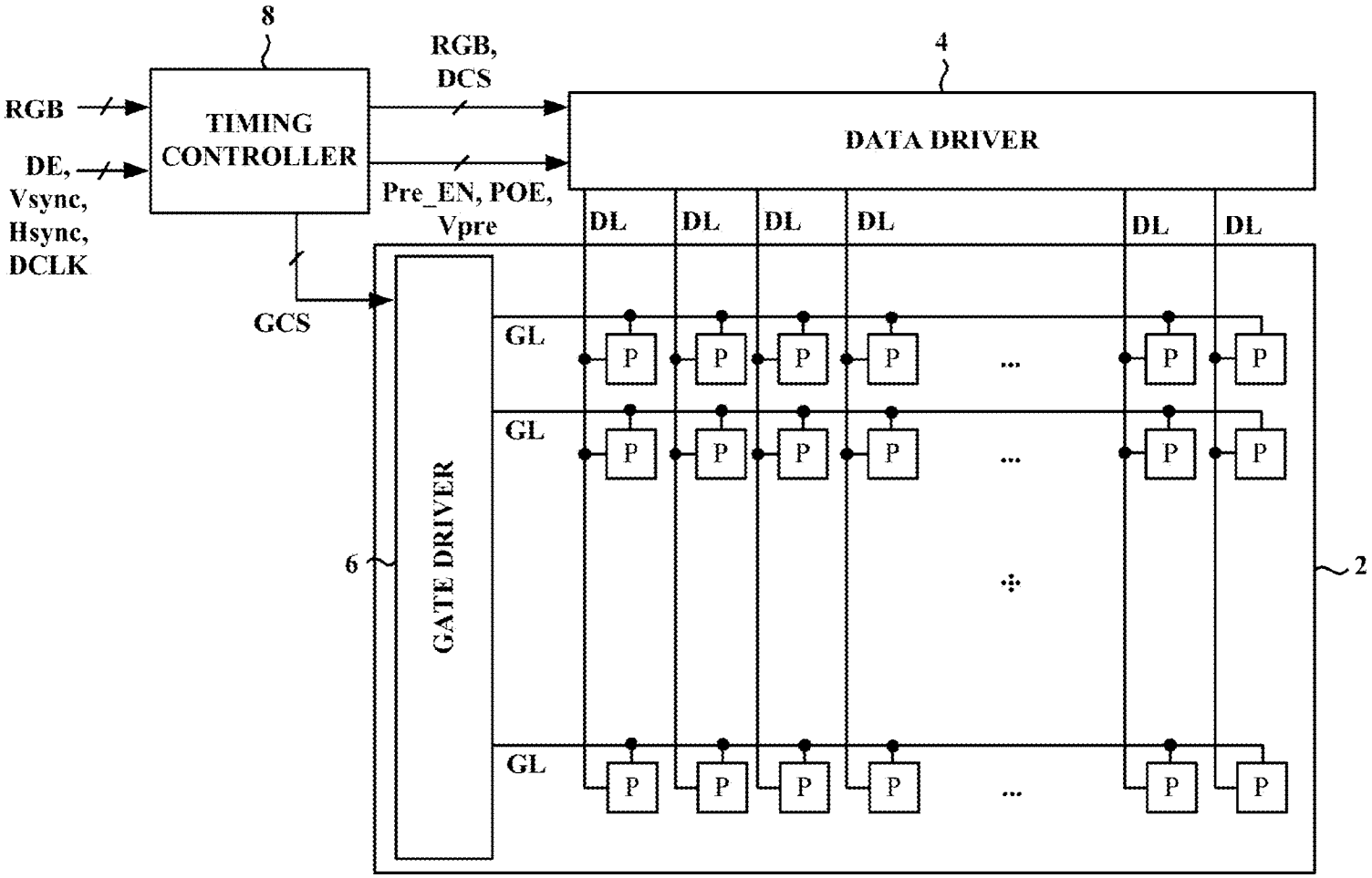
FIG. 1 is a block diagram illustrating a configuration of a display device according to an exemplary embodiment of the present invention.

FIG. 1 is a block diagram illustrating a configuration of a display device according to an exemplary embodiment of the present invention.

The display device shown in FIG. 1 includes a display panel 2, a data driver 4, a gate driver 6, and a timing controller 8.

The display panel 2 includes a plurality of data lines DL and a plurality of gate lines GL, which intersect each other, and logic pixels P arranged in the form of a matrix. The display panel 2 may be implemented using one of a liquid crystal display (LCD) device, a light emitting display device such as an organic light emitting diode (OLED) display device, and an electrophoretic display (EPD) device.

The data driver 4 receives image data from the timing controller 8. The image data may include three or four colors data. For example, the three colors data include Red, Green and Blue (RGB) data. The four colors data include Red, Green, Blue and White (RGBW) data. In response to a data control signal DCS from the timing controller 8, the data driver 4 converts the image data into a gamma-compensated voltage to generate a data voltage. The data driver 4 supplies the data voltage to the data lines DL of the display panel 2 in sync with a scan signal. The data driver 4 may supply pre-charge voltage Vpr to each of the data liens DL in pre-charge mode.

The gate driver 6 includes a gate shift register. The gate shift register includes stages each shifting a gate start pulse supplied from the timing controller 8 in accordance with a gate shift clock. Accordingly, the stages output scan signals in a sequential manner, respectively. The gate driver 6, which has the above-described configuration, may be directly formed on a lower substrate of the display panel 2 in the form of a gate-in-panel (GIP) structure or may be connected between the gate lines GL of the display panel 2 and the timing controller 8 in a tape automated bonding (TAB) manner.

The timing controller 8 controls driving timings of the gate driver 4 and data driver 6. To this end, the timing controller 8 generates a plurality of gate control signals GCS and a plurality of data control signals DCS, using synchronization signals input from outside, namely, a horizontal synchronization signal Hsync, a vertical synchronization signal Vsync, a dot clock DCLK, and a data enable signal DE, and outputs the generated signals.

The plural gate control signals GCS include a plurality of clock pulses having different phase differences, a gate start pulse instructing driving start of the gate driver 4, etc. Also, the plural data control signals DCS include a source output enable (SOE) signal for controlling an output period of the data driver 6, a source start pulse (SSP) instructing start of image data sampling, a source shift clock (SSC) for controlling sampling timing of image data, etc.

In particular, in an embodiment of the present invention, a charge share mode or a pre-charge mode is selectively applied in accordance with the swing width of the data voltage, to reduce power consumption and heat generation of the data driver 4.

To this end, the timing controller 8 defines input image data as positive data or negative data on the basis of reference data. When two successively-input pieces of input data RGB are defined as having the same polarity, the timing controller 8 outputs a pre-charge enable signal Pre_EN. In response to the pre-charge enable signal Pre_EN from the timing controller 8, the data driver 4 supplies a pre-charge voltage Vpre to a corresponding output channel.

Hereinafter, the embodiment of the present invention will be described in more detail.

Figure 2:
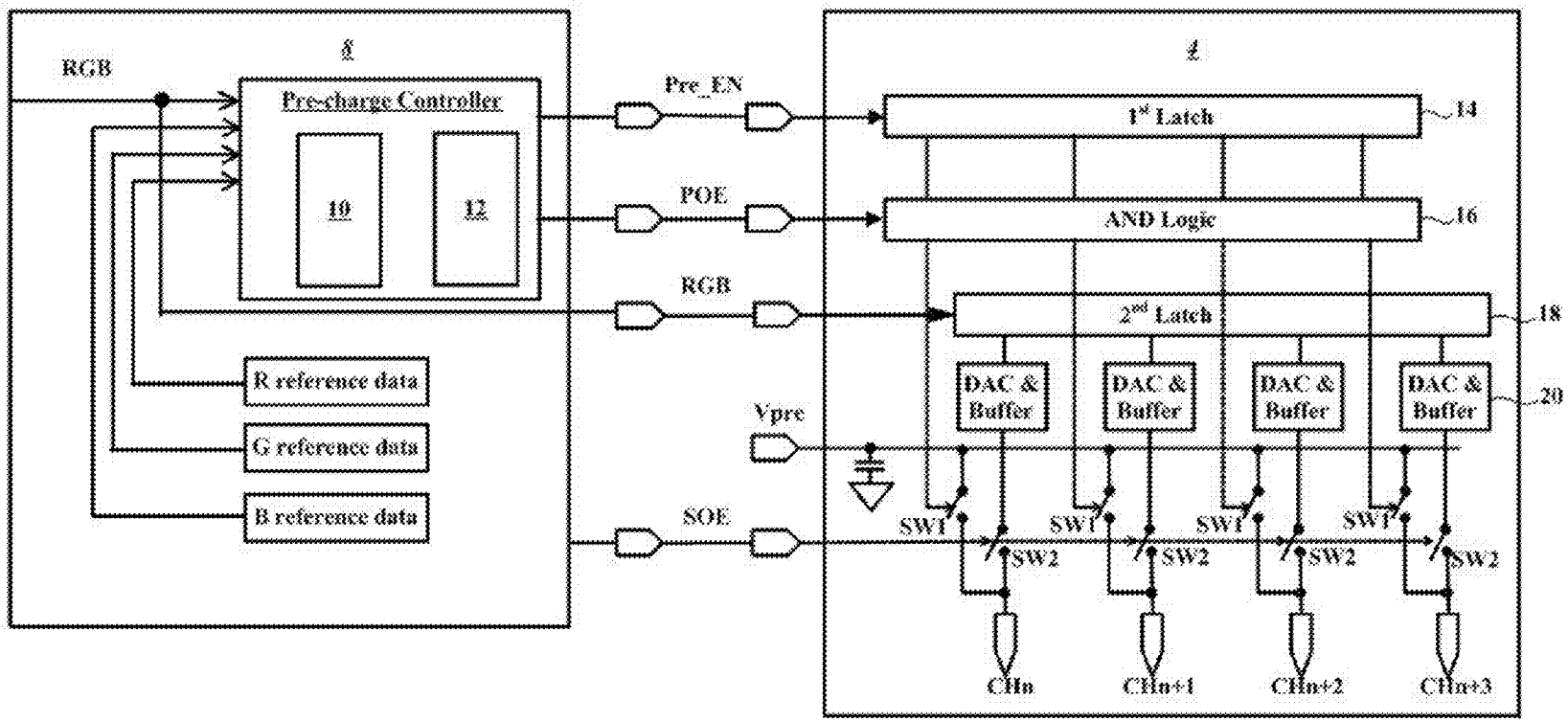
FIG. 2 is a block diagram illustrating detailed configurations of a timing controller and a data driver, which are shown in FIG. 1.

FIG. 2 is a block diagram illustrating detailed configurations of the timing controller 8 and data driver 4 shown in FIG. 1.

Referring to FIG. 2, the timing controller 8 includes a pre-charge controller for selectively controlling the charge share mode and the pre-charge mode of the data driver 4. The pre-charge controller includes a polarity determiner 10 and a comparator 12.

The polarity determiner 10 has a predetermined reference data, and outputs a first polarity data "1" when input image data is equal to or higher than the reference data. When the input image data RGB is lower than the reference data, the polarity determiner 10 outputs a second polarity data "0".

The polarity determiner 10 can achieve most accurate polarity determination as to the input image data when the input image data RGB is compared with the reference data for all bits thereof. For easy implementation, however, the polarity determiner 10 may compare the input image data RGB with the reference data only for 4 higher-order bits thereof. That is, although the polarity determiner 10 exhibits an error rate of 50% when analyzing image data only for the 1 higher-order bit thereof, the error rate is reduced to 10% or less (accuracy of 93.75%) when the image data is analyzed for 4 higher-order bits thereof. In this regard, the polarity determiner 10 preferably compares the image data RGB with the reference data for 4 higher-order bits thereof.

The comparator 12 outputs a pre-charge enable signal Pre_EN having a high level which indicates the pre-charge mode, when the first polarity data "1" is continuously supplied from the polarity determiner 10 or when the second polarity data "0" is continuously supplied from the polarity determiner 10. Otherwise, the comparator 12 outputs a pre-charge enable signal Pre_EN having a low level which indicates the charge share mode.

Figure 3:
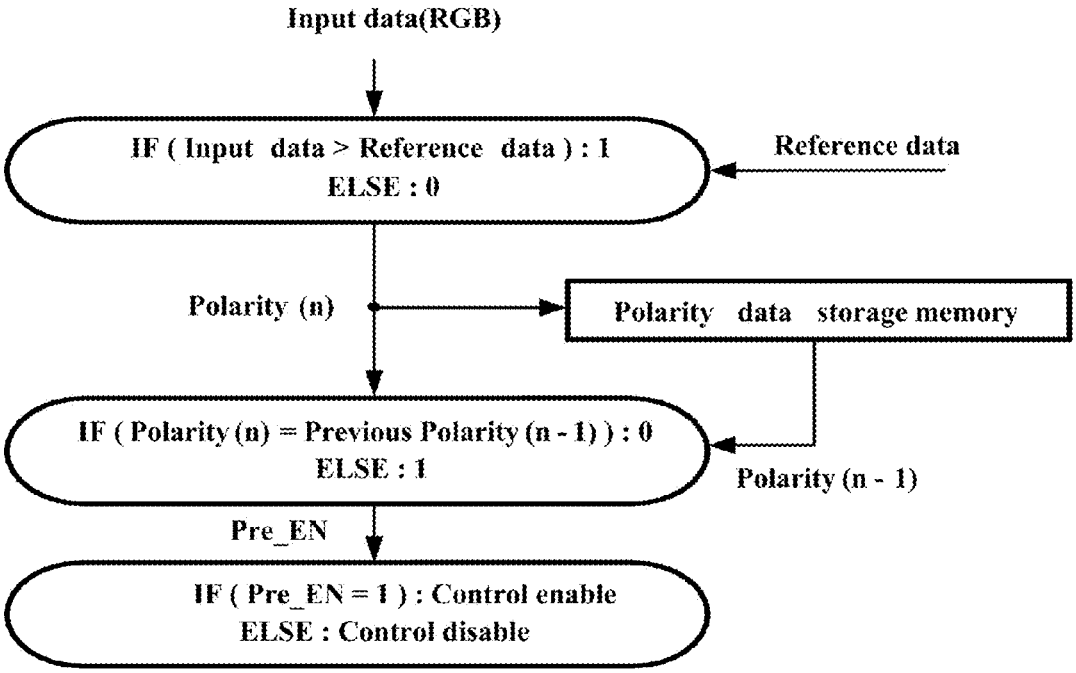
FIG. 3 is a flowchart explaining operation of a pre-controller.

That is, as shown in FIG. 3, the pre-charge controller defines the polarity of the input image data as a positive polarity data "1" as the first polarity data or a negative polarity data "0" as the second polarity data, and stores the defined polarity data in a polarity data memory. The pre-charge controller then compares the polarity data "n" of the current image data with the polarity data "n−1" of the previous image data from the polarity data memory. When the compared polarity data are equal, the pre-charge controller outputs a pre-charge enable signal Pre_EN having a low level. Otherwise, the pre-charge controller outputs a pre-charge enable signal Pre_EN having a high level.

Figure 4A:
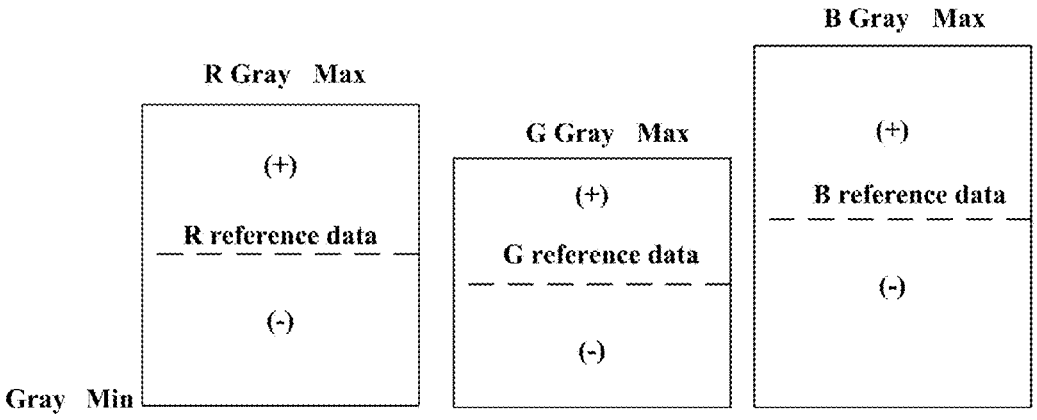
FIGS. 4A and 4B are diagrams explaining a method for defining reference data.
Figure 4B:
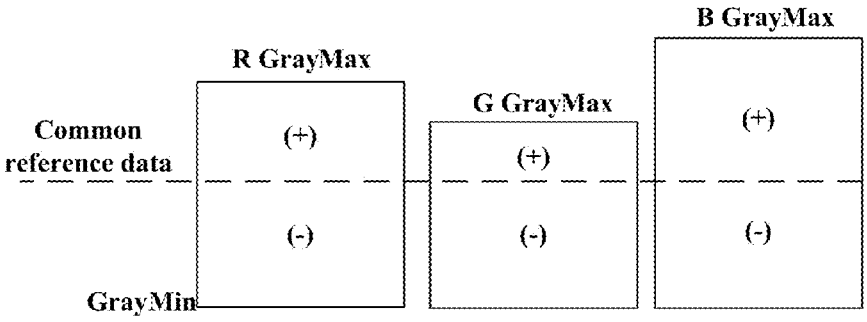

Meanwhile, the reference data predetermined in the charge controller may be defined for R, G and B data individually, as shown in FIG. 4A. Accordingly, in the illustrated embodiment, it may be possible to apply the reference data even when different driving voltages are used for 3-color data RGB. In this case, the reference data may include R reference data for determining the polarity of R data, G reference data for determining the polarity of G data, and B reference data for determining the polarity of B data. Alternatively, as shown in FIG. 4B, the reference data according to the illustrated embodiment may be single reference data, which is applicable in common to the 3-color data RGB, even when different driving voltages are used for the 3-color data RGB. Thus, the illustrated embodiment may be applicable not only to a liquid crystal display device in which driving voltages of 3-color data RGB are equal, but also to a light emitting display device such as an OLED display device in which driving voltages of 3-color data RGB are different. Also, the reference data may be defined for R, G, B and W data individually or in common.

As shown in FIG. 2, the data driver 4 includes a first latch 14, an AND logic 16, and a pre-charging switch unit.

The first latch 14 sequentially latches pre-charge enable signals Pre_EN supplied from the timing controller 8 and output the latched pre-charge enables signals Pre_EN at the same time.

The AND logic 16 performs an AND operation of a pre-charge out enable signal POE supplied from the timing controller 8 and each of pre-charge enable signals Pre_EN supplied from the latch 14.

The pre-charging switch unit includes a plurality of pre-charging switches SW1 provided to correspond to respective output channels CHn~CHn+3 of the data driver 4. In response to output signals from the AND logic 16, the pre-charging switch unit supplies a pre-charge voltage Vpre to respective output channels CHn~CHn+3. When an output signal from the AND logic 16 has a high level, the pre-charging switch SW1 supplies the pre-charge voltage Vpre to the corresponding output channel CH.

The pre-charge out enable signal POE supplied from the pre-charge controller of the timing controller 8 may be a signal synchronized with or identical to the source output enable signal SOE, which defines the output period of the data driver 4. Also, the pre-charge voltage Vpre is a voltage supplied from the pre-charge controller of the timing controller 8, and is set as a voltage corresponding to reference data. Accordingly, when the pre-charge controller of the timing controller 8 sets reference data for 3-color data RGB or 4-color data RGBW, respectively, pre-charge voltages Vpre may be seted for the 3-color data RGB or 4-color data RGBW, respectively.

Also, the data driver 4 further includes a second latch 18 for latching the image data from the timing controller 8, a plurality of digital-to-analog converters (DACs) and buffers 20 for converting the image data from the second latch 18 to data voltages, respectively. The data driver 4 further includes a plurality of second switches SW2 outputting the data voltages from the buffers 20 to the output channels CHn~CHn+3, respectively, after supplying the pre-charge voltage Vpre in accordance with the SOE signal from the timing controller 8 when the pre-charge mode.

The data driver 4 may supply the data voltages from the buffers 20 to the output channels CHn~CHn+3, without supplying the pre-charge voltage Vpre, in accordance with the SOE signal when the charge share mode. The data driver 4 shorts the output channels CHn~CHn+3 each other to share charges between the output channels CHn~CHn+3 by third switches (not shown) between the output channels CHn~CHn+3 in a disable period of the SOE signal when the charge share mode.

Hereinafter, an example of operation in the above-described embodiment will be described.

Figures 5, 6:
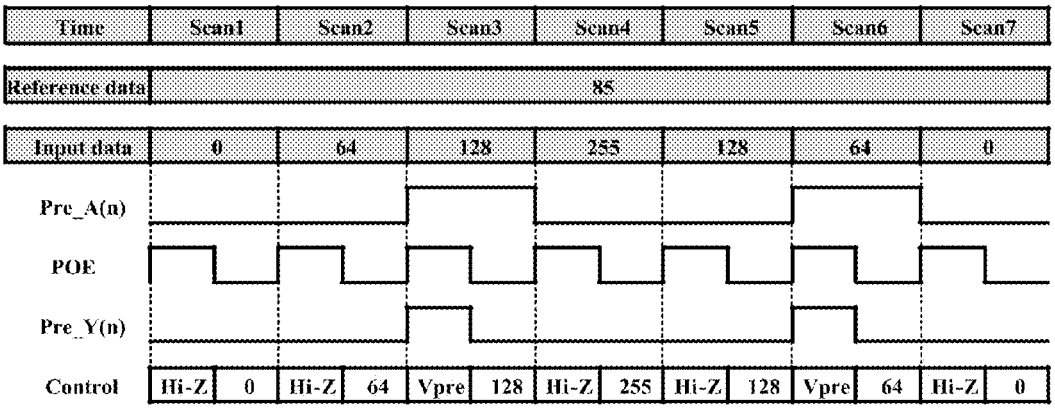
FIG. 5 is a table explaining operations in the illustrated embodiment.
FIG. 6 is a driving waveform diagram explaining operations in the illustrated embodiment.

FIG. 5 is a table explaining operations in the illustrated embodiment. FIG. 6 is a driving waveform diagram explaining operations in the illustrated embodiment. In this example, it is assumed that the reference data is single reference data applied in common to RGB data, and is set to "85". Accordingly, when the input image data RGB is equal to or higher than "85", the polarity thereof is determined as "positive (1)". On the other hand, when the input image data RGB is lower than "85", the polarity thereof is determined as "negative (0)".

Referring to FIG. 5, the input image data RGB is determined as "positive (1)" in a period from a time Scan3 to a time Scan5 because it has a higher value than "85". On the other hand, in a period from a time Scan1 to a time Scan 2 and in a period from a time Scan6 to a time Scan7, the input image data RGB is determined as "negative (0)" because it has a lower value than "85". In this case, the polarities of successive pieces of the image data RGB are varied in periods respectively corresponding to times Scan3 and Scan6. Accordingly, the pre-charge enable signal Pre_EN output in the polarity varying periods has a high level (1), whereas the pre-charge enable signal Pre_EN output in the periods other than the polarity varying periods has a low level (0).

The data driver 4 receives the above-described pre-charge enable signal Pre_EN. In response to the high-level pre-charge enable signal Pre_EN, the data driver outputs the pre-charge voltage Vpre in the Scan3 and Scan6 periods and in a period in which the pre-charge out enable signal POE has a high level. In response to the low-level pre-charge enable signal Pre_EN, the data driver 4 disables the pre-charge mode and enables the charge share mode.

As apparent from the above description, in the present invention, a charge share mode or a pre-charge mode is selectively applied in accordance with the swing width of a data voltage, thereby reducing power consumption and heat generation of the data driver 4. In accordance with the present invention, there is an advantage in that the present invention is applicable even when different driving voltages are used for RGB or RGBW data, as in a light emitting display device such as an OLED display device.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A display device comprising:

a display panel, in which pixels are defined by intersection of a plurality of gate lines and a plurality of data lines;

a timing controller for determining a positive or negative polarity of input image data on the basis of reference data and outputting a pre-charge enable signal when successive image data have a different polarity;

a data driver for converting image data supplied from the timing controller into a data voltage, supplying the converted data voltage to the corresponding data line through a corresponding output channel, and supplying a pre-charge voltage to the corresponding output channel in response to the pre-charge enable signal; and a gate driver for supplying scan signals to the gate lines, respectively, wherein the timing controller comprises a pre-charge controller for selectively controlling the charge share mode and the pre-charge mode of the data driver, and wherein the pre-charge controller includes:

a polarity determiner for outputting a first polarity data when input image data is equal to or higher than the reference data, and outputting a second polarity data when the input image data is lower than the reference data, and a comparator for comparing polarity data of a current image data with polarity data of a previous image data, and if the compared polarity data are equal, the comparator outputs a pre-charge enable signal which indicates the pre-charge mode, and otherwise the comparator outputs a pre-charge enable signal which indicates the charge share mode.

2. The display device according to claim 1, wherein the reference data is predetermined for R, G and B data individually or in common.

3. The display device according to claim 1, wherein the reference data is predetermined for R, G, B and W data individually or in common.

4. The display device according to claim 1, wherein the polarity determiner compares the input image data with the reference data for 4 higher-order bits thereof, and outputs the polarity data based on a result of the comparison.

5. The display device according to claim 1, wherein the data driver comprises:

a latch for sequentially latching the pre-charge enable signal supplied from the timing controller;

an AND logic for ANDing a pre-charge out enable signal supplied from the timing controller and the pre-charge enable signal supplied from the latch; and a pre-charging switch unit for supplying the pre-charge voltage to the corresponding output channel when an output signal from the AND logic has a high level.

6. The display device according to claim 5, wherein the pre-charge out enable signal is a signal synchronized with or identical to a source output enable (SOE) signal, which defines an output period of the data driver.

7. The display device according to claim 5, wherein the pre-charge voltage is a voltage corresponding to the reference data.

8. A method for driving a display device, comprising the steps of:

determining a positive or negative polarity of input image data on the basis of reference data and outputting a pre-charge enable signal when two successive image data have a different polarity;

supplying a pre-charge voltage to a corresponding output channel in response to the pre-enable signal; and converting the image data into a data voltage, supplying the converted data voltage to a corresponding data line through the corresponding output channel, wherein the step of outputting the pre-charge enable signal includes the steps of:

(A) outputting a first polarity data when the input image data is equal to or higher than the reference data, and outputting a second polarity data when the input image data is lower than the reference data, and (B) comparing polarity data of a current image data with polarity data of a previous image data, and if the compared polarity data are equal, outputting a pre-charge enable signal which indicates a pre-charge mode, and the otherwise outputting a pre-charge enable signal which indicates a charge share mode.

9. The method according to claim 8, wherein the reference data is predetermined for R, G and B data individually or in common.

10. The method according to claim 8, wherein the reference data is predetermined for R, G, B and W data individually or in common.

11. The method according to claim 8, wherein the step (A) comprises the step of comparing the input image data with the reference data for 4 higher-order bits thereof, and outputting the polarity data based on a result of the comparison.

12. The method according to claim 8, wherein the step of supplying the pre-charge voltage to the corresponding output channel in response to the pre-charge enable signal comprises the steps of:

sequentially latching the pre-charge enable signal corresponding each of the input image data;

ANDing a pre-charge out enable signal and the pre-charge enable signal, thereby outputting an ANDed signal; and supplying the pre-charge voltage to the corresponding output channel when the ANDed signal has a high level.

13. The method according to claim 12, wherein the pre-charge out enable signal is a signal synchronized with or identical to a source output enable (SOE) signal, which defines an output period of the data driver.

14. The method according to claim 12, wherein the pre-charge voltage is a voltage corresponding to the reference data.

* * * * *